US005887331A

United States Patent [19]

Little

[11] Patent Number: 5,887,331

[45] Date of Patent: Mar. 30, 1999

[54] METHOD OF DECK CONSTRUCTION USING POLYMER PLASTIC LUMBER

[76] Inventor: David L. Little, 5815 - 108 St., Edmonton, Canada, T6H 2Z1

[21] Appl. No.: 798,546

[22] Filed: Feb. 11, 1997

[51] Int. Cl.[6] ..... B21D 39/00

[52] U.S. Cl. ..... 29/509; 29/525.01; 52/650.3; 52/480

[58] Field of Search ..... 29/525.01, 525.11, 29/525.05, 509; 52/584.1, 592.1, 712, 650.3, 480

[56] References Cited

U.S. PATENT DOCUMENTS

| | | | |
|---|---|---|---|
| 582,645 | 5/1897 | Heaton | 52/480 |
| 1,898,364 | 2/1933 | Gynn | 52/480 |
| 2,038,433 | 4/1936 | Lawrence, Jr. | 52/480 |
| 3,267,630 | 8/1966 | Omholt | 52/480 |
| 3,393,488 | 7/1968 | Schneller | 52/480 |
| 3,553,919 | 1/1971 | Omholt | 52/480 |
| 3,713,264 | 1/1973 | Morgan, Jr. | 52/480 |
| 5,394,667 | 3/1995 | Nystrom | 52/480 |
| 5,623,803 | 4/1997 | Willis | 52/650.3 |
| 5,660,016 | 8/1997 | Erwin et al. | 52/480 |
| 5,768,850 | 6/1998 | Chen | 52/480 |

*Primary Examiner*—David P. Bryant
*Attorney, Agent, or Firm*—Anthony R. Lambert

[57] ABSTRACT

A method of deck construction using polymer plastic lumber. Firstly, form a frame structure. Secondly, provide a plurality of polymer plastic boards having at least one axially extending groove. Thirdly, secure each of the polymer plastic boards to the frame structure by means of clips having projecting tabs that fit into the axially extending groove of the polymer plastic board. This securely fastens the polymer plastic board to the frame structure while permitting the axially extending groove to move along the tabs of the fixed clips upon thermal expansion and contraction of the polymer plastic board.

14 Claims, 7 Drawing Sheets

METHOD OF DECK CONSTRUCTION USING POLYMER PLASTIC LUMBER

FIELD OF THE INVENTION

The present invention relates to a method of deck construction using polymer plastic lumber.

BACKGROUND OF THE INVENTION

As construction grade lumber becomes increasingly scarce and, consequently, more expensive, polymer plastic lumber has come into wide spread usage for building decks. The same construction techniques used with wood lumber have been used in the construction of decks out of polymer plastic lumber, with disastrous results. Unlike wood lumber, polymer plastic lumber experiences wide variations in length with variations in temperature. A 16 foot length of polymer plastic lumber may experience a variation in length of as much as 2 inches. During the coldest day of winter the polymer plastic lumber will have a length of 15 feet 11 inches. During the warmest day of summer the polymer plastic lumber will have a length of 16 feet 1 inches. This thermal expansion and contraction has the effect of pulling out fasteners and buckling materials.

SUMMARY OF THE INVENTION

What is required is a method of deck construction better suited to the use of polymer plastic lumber.

According to the present invention there is provided a method of deck construction using polymer plastic lumber. Firstly, forming a frame structure. Secondly, providing a plurality of polymer plastic boards having at least one axially extending groove. Thirdly, securing each of the polymer plastic boards to the frame structure by means of clips having projecting tabs that fit into the at least one axially extending groove of the polymer plastic board, thereby securely fastening the polymer plastic board to the frame structure while permitting the axially extending groove to move along the tabs of the fixed clips upon thermal expansion and contraction of the polymer plastic board.

With the method, as described above, the polymer plastic boards are free to expand and contract without interference from fasteners. The method can be used with both groove and groove style boards and tongue and groove style of boards.

Although beneficial results may be obtained through the use of the method, as described above, polymer plastic boards are currently being manufactured in sixteen foot lengths. A deck as short as sixteen feet in length is rarely constructed. Even more beneficial results may, therefore, be obtained when two or more polymer plastic boards are coupled in end to end relation to form a composite polymer plastic board of the requisite length. It is preferred that the polymer plastic boards be coupled by means of an interlocking butt joint. Good results have been obtained with the use of a dovetail joint.

Although beneficial results may be obtained with the method, as described above, most decks are encircled by a railing for safety reasons. Many jurisdictions have passed laws making it mandatory to have a railing for all decks above a specified height. In order to support a railing a plurality of support posts are required. When support posts for the railing are secured in place the free thermal expansion and contraction of the polymer plastic boards is restricted, totally defeating the intent of the system. Even more beneficial results may, therefore, be obtained when posts which support a railing are secured by the following steps. Firstly, providing tubular spacer members and posts having base plates with apertures to receive fasteners. Secondly, cutting slots in one of the polymer plastic boards of a sufficient width to accommodate the spacer members and of a sufficient length to accommodate anticipated thermal expansion and contraction. Thirdly, positioning the slotted polymer plastic board on the frame structure with the spacer members extending through the slots. Fourthly, securing the posts to the frame structure by driving fasteners through the apertures in the base plate of the post and through the tubular spacer member into the frame structure, such that thermal expansion and contraction of the polymer plastic board is accommodated by movement of the slots relative to the fixed tubular spacer members.

Although beneficial results may be obtained through the method, as described above, it is preferable that the manner of fastening the polymer plastic boards not be visible to an observer along the edges of the deck. Even more beneficial results may, therefore, be obtained when a slot is placed in the bottom face of the polymer plastic boards positioned along the edge of the deck. The slot has an axial leg and a transverse leg, to enable it to receive a bent over tab of the clip.

According to another aspect of the present invention there is provided a form of clip. Rather than have a variety of clips a universal saddle clip has been developed. This clip consists of a flat piece of metal which can be bent insitu as required. This approach is preferred due to the fact that the dimension of the lumber can vary slightly. The ability to bend the clip insitu permits one to adjust to the requirements of a particular installation. The universal saddle clip has a central portion and two opposed wing portions. A tab extends from the central portion intermediate the two wing portions. When attaching the clip nails have to be driven in close proximity. It is undesirable to have these nails strike each other. It is, therefore, preferred that the clip have at least one hole in each of the wing portions to accommodate fasteners. The holes in each of the wing portions are staggered on opposed sides of a dividing axis. This staggering of the holes reduces the likelihood of the nails striking each other. For some applications it is preferred that the clip also have at least one hole in the central portion to accommodate fasteners. This hole is positioned out of alignment with the holes in each of the wing portions.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
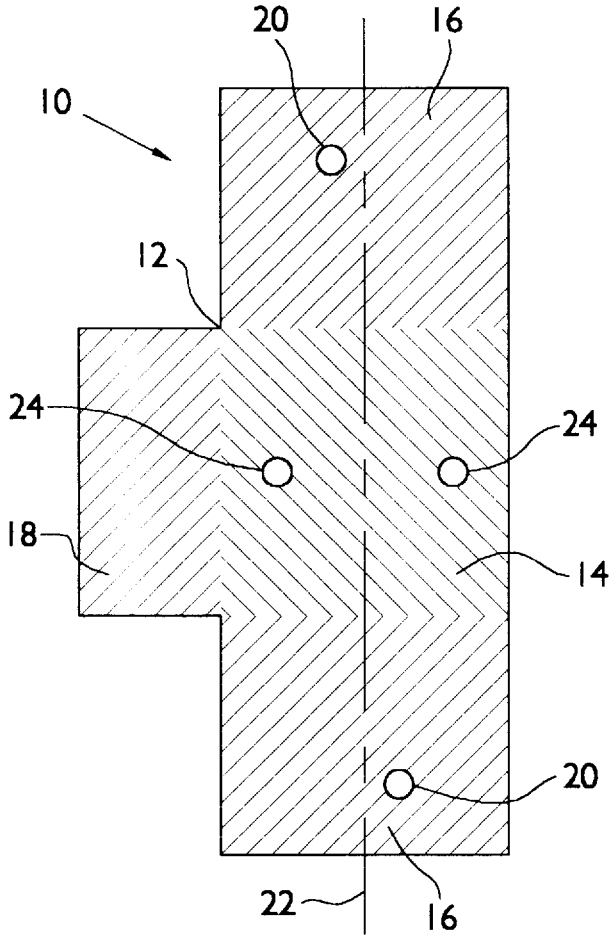
FIG. 1 is a top plan view of a clip constructed in accordance with the teachings of the present invention.
Figure 2:
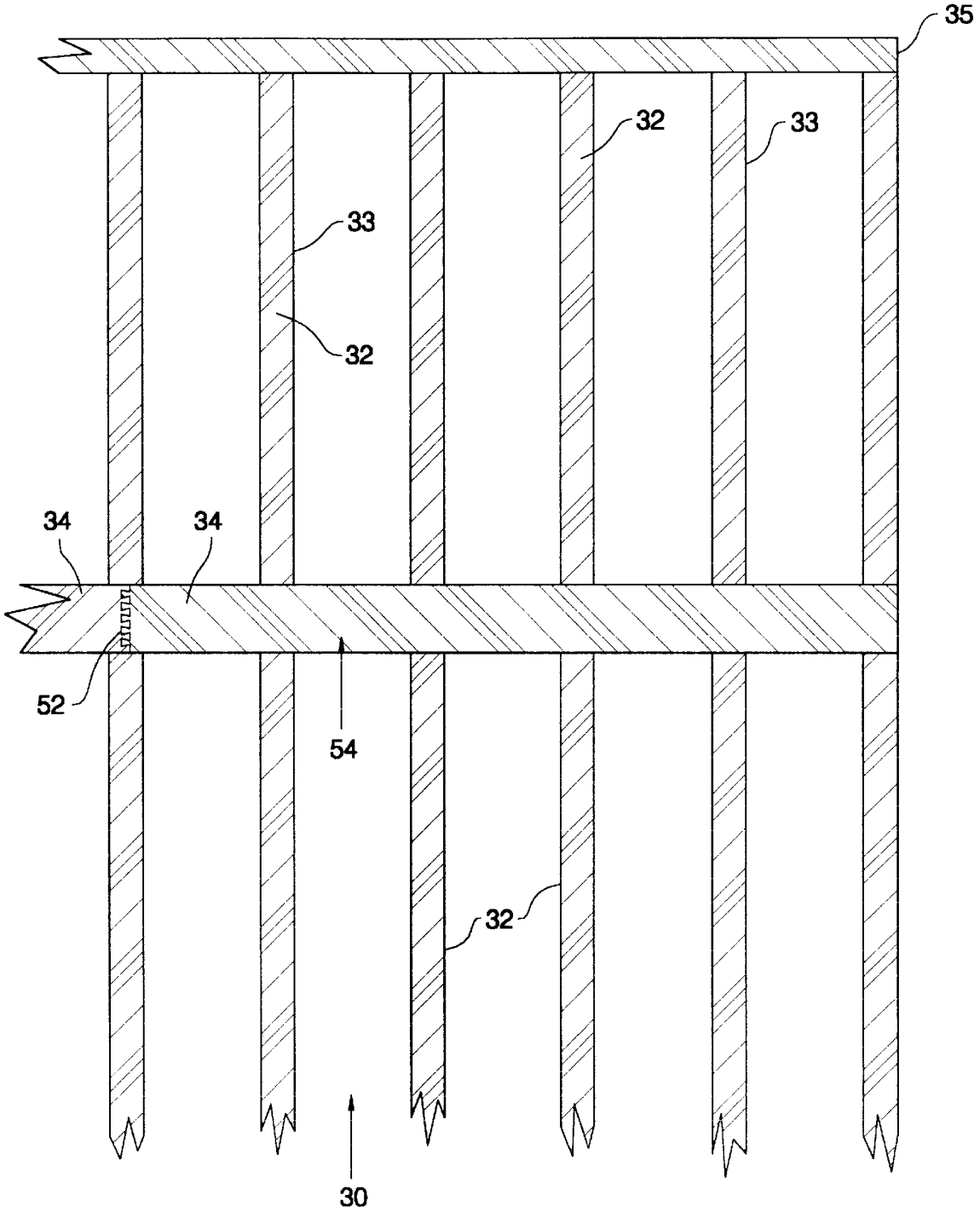
FIG. 2 is a top plan view of a frame structure for a deck.

In describing the preferred method, reference will be made to a clip 10. The preferred form of clip 10 is illustrated in FIG. 1. Clip 10 is a flat piece of metal plate 12. The metal selected must be strong enough to enable clip 10 to have holding ability and yet must be permit metal plate 12 to be bent insitu as will hereinafter be further described in relation to the method. Clip 10 has a central portion 14 and two opposed wing portions 16. A tab 18 extends from central portion 14 intermediate two wing portions 16. Clip 10 has holes 20 in each of wing portions 16 to accommodate fasteners. Holes 20 are staggered on opposed sides of a dividing axis, indicated by reference numeral 22. Clip 10 also has one or two holes 24 in central portion 14 to accommodate fasteners. Holes 24 are out of alignment with holes 20 in wing portions 16.

Figure 3:
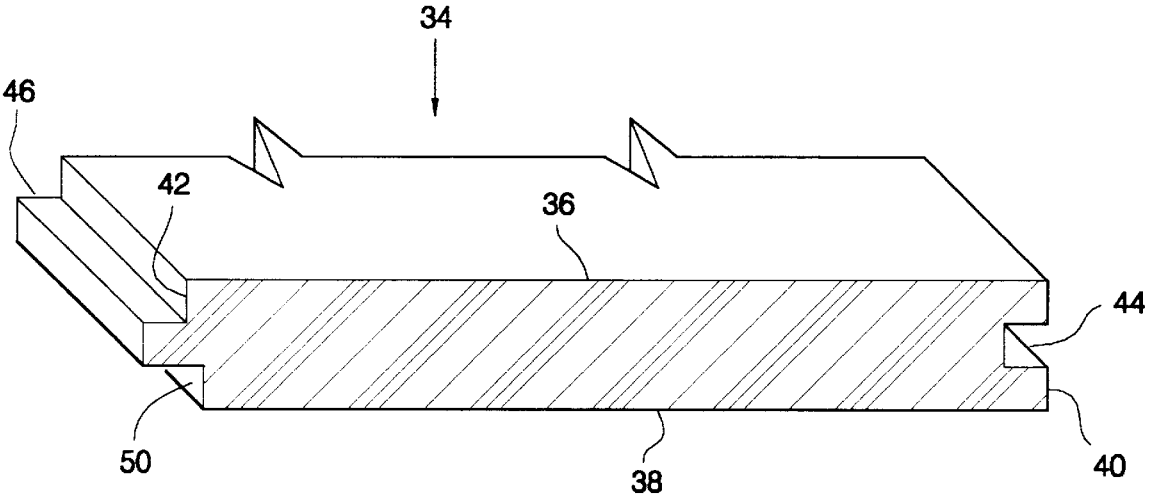
FIG. 3 is a perspective view of a tongue and groove polymer plastic board.
Figure 4:
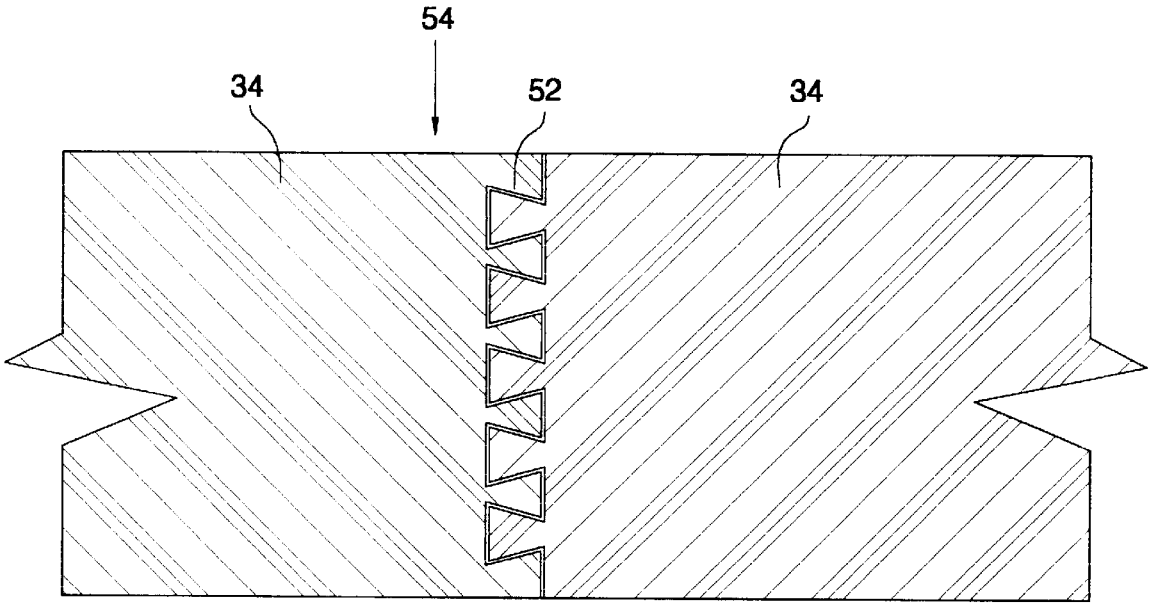
FIG. 4 is a top plan view for a first form of butt end joint connecting two polymer plastic boards.
Figure 5:
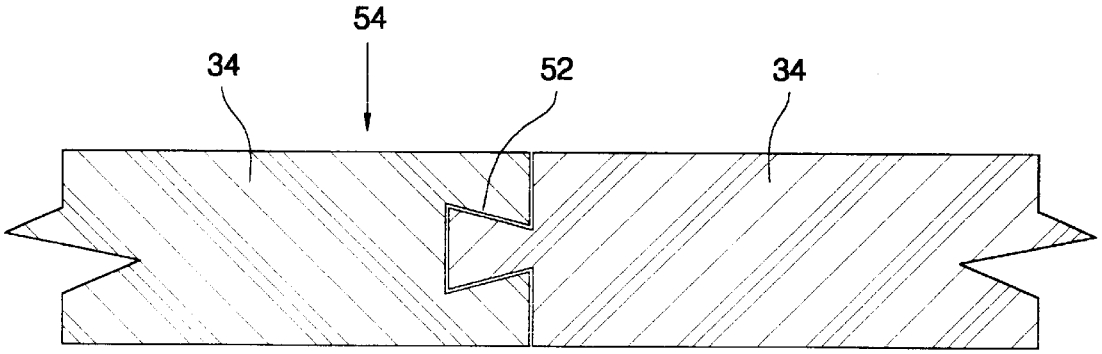
FIG. 5 is a side elevation view for a second form of butt end joint connecting two polymer plastic boards.
Figure 6:
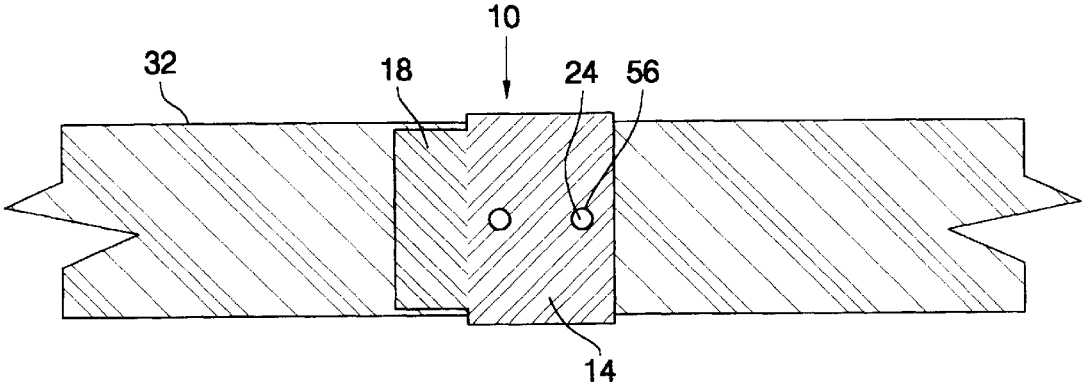
FIG. 6 is a top plan view of the clip illustrated in FIG. 1 bent to fit onto a frame structure.
Figure 7:
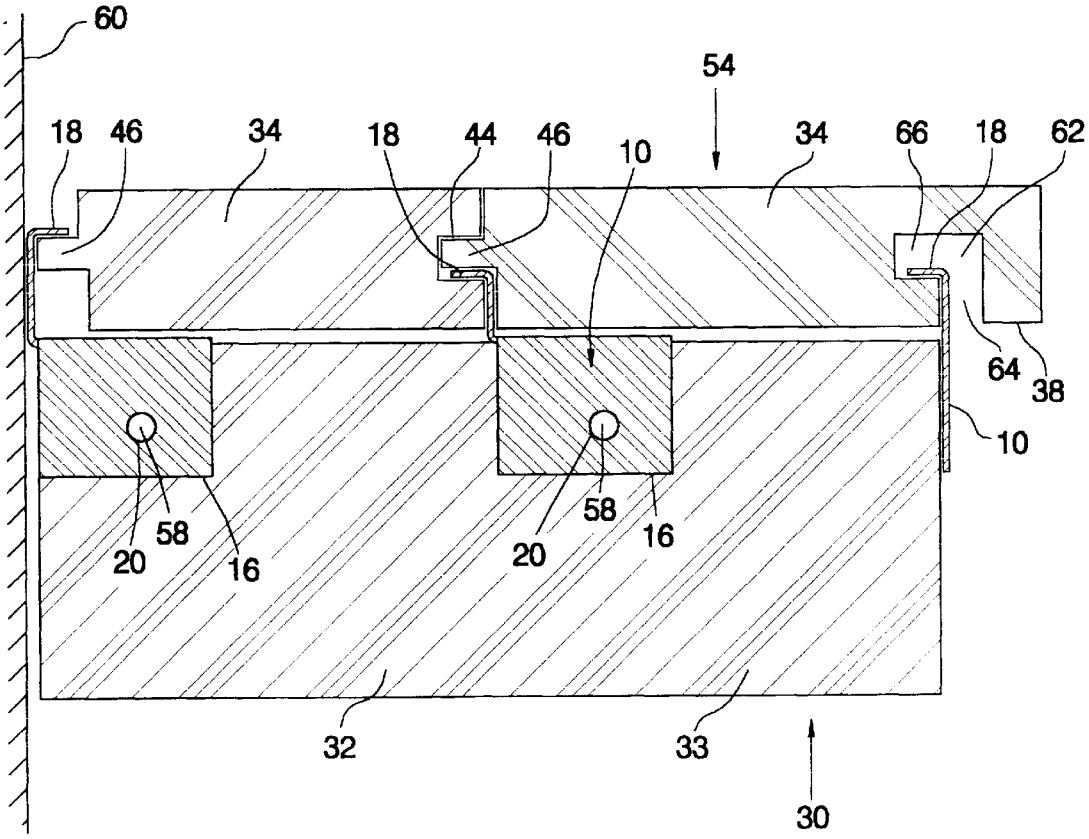
FIG. 7 is a side elevation view of the clip illustrated in FIG. 1 with tab bent in various configurations to secure polymer plastic boards to a frame structure.
Figure 8:
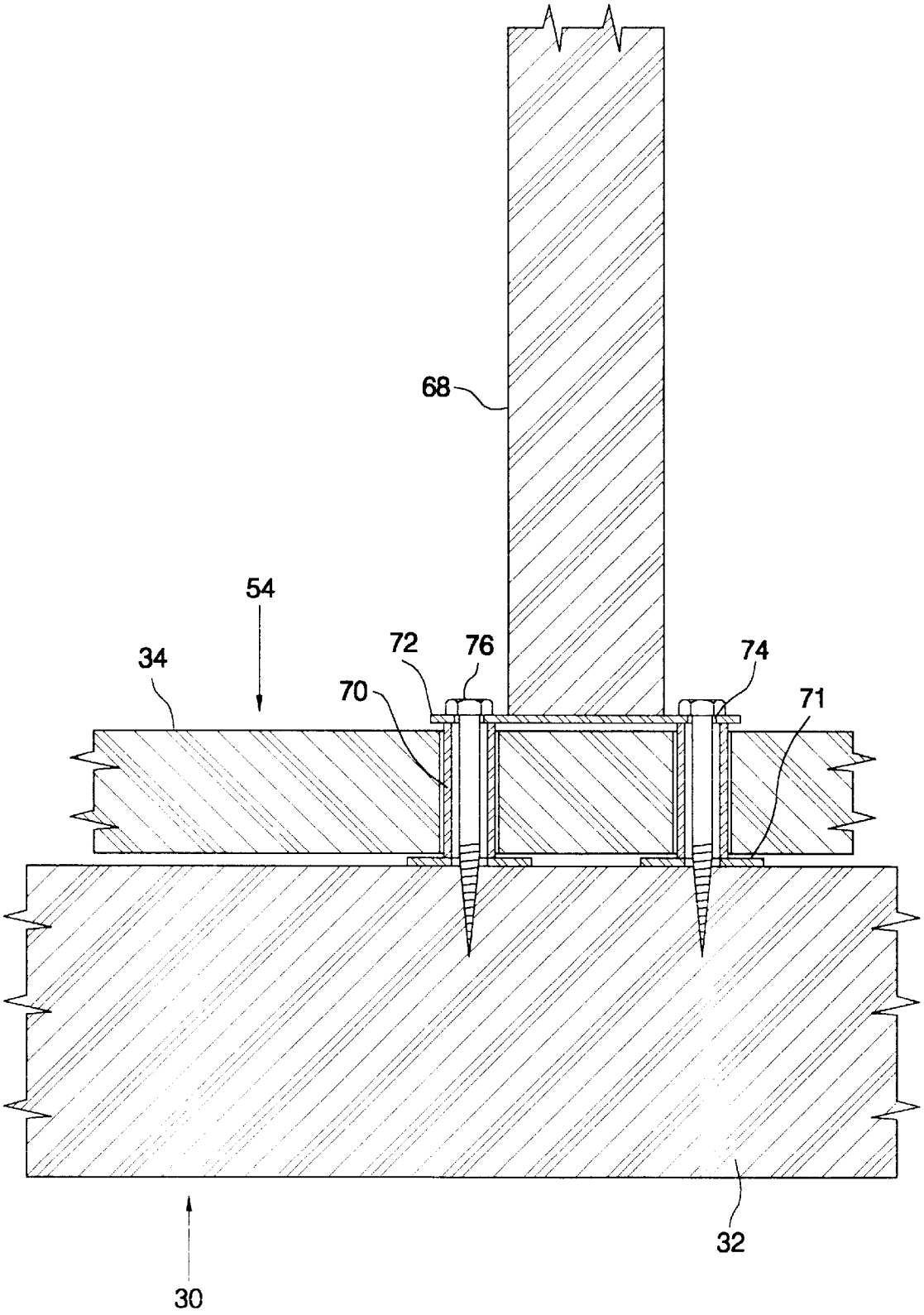
FIG. 8 is a side elevation view, in section, of a post secured to a frame structure in accordance with the teachings of the method.
Figure 9:
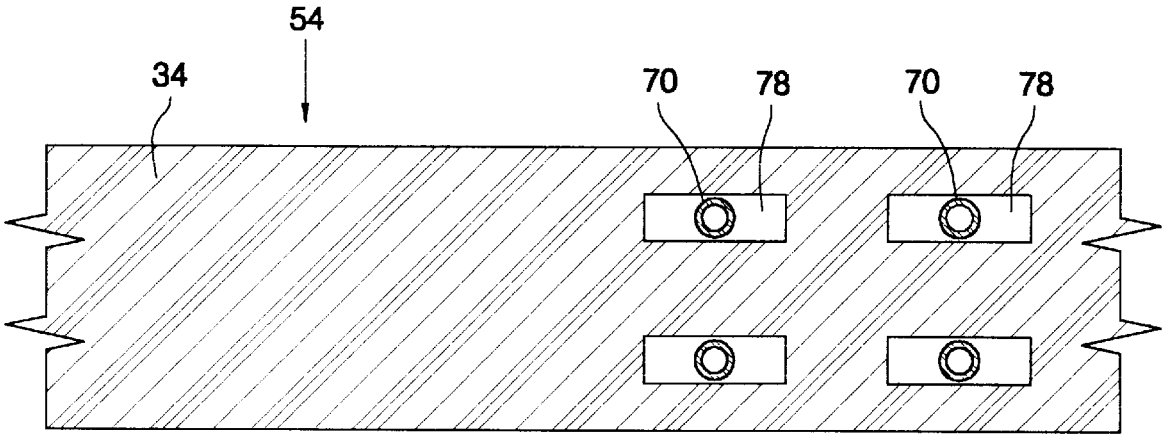
FIG. 9 is a top plan view, in section, of the post illustrated in FIG. 8.

The preferred method of deck construction using polymer plastic lumber will now be described with reference to FIGS. 1 through 9. Firstly, referring to FIG. 2, form a frame support structure 30 with a plurality of interconnected frame members 32. Each frame member has opposed sides 33 and opposed ends 35. In view of the thermal expansion and contraction of polymer plastic lumber it is preferable that frame support structure 30 be fabricated from wood lumber or steel frame members. Secondly, referring to FIG. 3, provide a plurality of tongue and groove style polymer plastic boards 34. Each polymer plastic board 34 has a top 36, a bottom 38, and opposed sides 40 and 42. An axially extending groove 44 extends along side 40 and a projecting tongue 46 extends along opposed side 42. In order to accommodate clip 10, as will hereinafter be further described, it is preferred that a notch 50 extend from bottom 38 to the underside of tongue 46 and that the underside tongue 46 be shaved slightly so that both tab 18 of clip 10 and tongue 46 may be accommodated in groove 44. Thirdly, referring to FIGS. 4 and 5, secure pairs of polymer plastic boards 34 in end to end relation by means of interlocking butt joints 52 to form composite polymer plastic boards 54. FIG. 4 illustrates a preferred form of interlocking butt joint 52 that uses a dovetail type of interlock. FIG. 5 illustrates how the same form of interlocking butt joint 52 can be configured so it is not visible when composite polymer plastic board 54 is viewed from top 36. Fourthly, referring to FIGS. 6 and 7, secure each of composite polymer plastic boards 54 sequentially to frame support structure 30 by means of clips 10. There are two ways in which clips 10 are secured to individual frame members 32 of frame support structure 30. Referring to FIG. 6, along the length of frame member 32, clips 10 are secured by driving a nail 56 through holes 24 of central portion 14. It is preferred that two holes 24 be provided. Placing nails 56 through two holes 24, helps to prevent clip 10 from twisting out of position. When frame member 32 is made from metal, clip 10 may be secured with two rivets. Referring to FIG. 7, once clip 10 is secured to frame member 32 in the fashion illustrated in FIG. 6, wing portions 16 are hammered down to engage sides 33 and nails 58 inserted through holes 20. As previously described, holes 20 and 24 are staggered and positioned out of alignment so that nails 56 and 58 do not strike each other. When clip 10 is being secured at an edge of frame support structure 30, it may be secured without bending by inserting nails 56 and 58 through holes 24 and 20, respectively. There are two ways in which projecting tab 18 is bent to hold composite polymer plastic board 54. In most instances, tab 18 is bent to assume an "L" shaped configuration which engages enlarged groove 44. Along concealed peripheral edges, such as adjacent to a wall 60, tab 18 is bent to assume a "U" shaped configuration which engages tongue 46. Along peripheral edges that are visible, an axially extending slot 62 is placed in bottom 38 of composite polymer plastic board 54. Slot 62 has an axial leg 64 and a transverse leg 66. Tab 18 is bent to assume an "L" shaped configuration prior to insertion into slot 62, so that tab extends up into axial leg 64 and hooks onto transverse leg 66. The manner of fastening of composite polymer plastic boards 54 with clips 10 prevent composite polymer plastic boards 54 from being pulled away from frame support structure 30, while permitting composite polymer plastic boards 54 to slide relative to the fixed position of clips 10. This sliding movement is inevitable upon thermal expansion and contraction of composite polymer plastic board 54. Of course, the longer the length of the composite polymer plastic board 54, the more pronounced is the expansion and contraction. As previously described, groove 44 can accommodate both tab 18 of clip 10 and tongue 46 of an adjacent composite polymer plastic board 54. Fifthly, referring to FIGS. 8 and 9, secure posts 68 to support a railing (not shown) to frame structure 30. In order to ensure that movement required for thermal expansion and contraction is not adversely effected, tubular spacer members 70 are used for the preferred method of attachment of posts 68. Each of tubular spacer members 70 has a broad weight distributing base 71. Referring to FIG. 8, each of posts 68 have a base plate 72 with apertures 74 to receive fasteners 76. Referring to FIG. 9, slots 78 are cut in composite polymer plastic board 54 of a sufficient width to accommodate spacer members 70 and of a sufficient length to accommodate anticipated thermal expansion and contraction. Spacer members 70 are positioned on frame support structure 30 at the desired post location. Composite polymer plastic board 54 is then positioned on frame support structure 30 with spacer members 70 extending through slots 78. Referring to FIG. 8, posts 68 are then secured to frame support structure 30 by driving rotatable fasteners 76 through apertures 74 in base plate 72 and through tubular spacer members 70 into frame support structure 30. When thermal expansion and contraction of composite polymer plastic board 54 occurs, it is accommodated by movement of slots 78 relative to the fixed position on frame support structure 30 of tubular spacer members 70. Spacer members 70 should be slightly longer than the thickness of composite polymer plastic board 54 in order that base plate 72 of posts 68 may rest upon spacer members 70 without clamping composite polymer plastic board 54 to frame structure 30. Spacer members 70 preferably have a broad base 71, so that they do not dig into the surface frame member 32 when a weight is placed upon post 68.

It will be apparent to one skilled in the art that the described method accommodates thermal expansion and contraction of polymer plastic boards. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of deck construction using polymer plastic lumber, comprising the steps of:

firstly, forming a frame structure;

secondly, providing a plurality of polymer plastic boards having at least one axially extending groove; and thirdly, securing each of the polymer plastic boards to the frame structure by means of clips, each clip having a projecting portion that fits into the at least one axially extending groove of the polymer plastic board, thereby securely fastening the polymer plastic board to the frame structure while permitting the axially extending groove to move relative to the tabs of the fixed clips upon thermal expansion and contraction of the polymer plastic board, wherein each clip comprises a flat piece of metal which can be bent in situ, the clip having a central portion, two opposed wing portions, and a tab portion extending from the central portion intermediate the two wing portions, and wherein the securing step comprises bending the two opposed wing portions against the frame structure and securing the wing portions thereto, and bending the tab portion into the axially extending groove of the polymer plastic board.

2. The method as defined in claim 1, the polymer plastic boards being tongue and groove style with the at least one axially extending groove along one side and a projecting tongue along an opposed side, the at least one axially extending groove accommodating both the tongue of an adjacent polymer plastic board and the tabs of the clips while permitting the grooves to move relative to the tabs of the fixed clips upon thermal expansion and contraction of the polymer plastic board.

3. The method as defined in claim 1, wherein when a deck is to be constructed that exceeds the length of the polymer plastic boards, at least two polymer plastic boards being coupled in end to end relation to form a composite board of the requisite length.

4. The method as defined in claim 3, the at least two polymer plastic boards being coupled by means of an interlocking butt joint.

5. The method as defined in claim 4, the interlocking butt joint being a dovetail joint.

6. The method as defined in claim 1, further comprising securing posts to support a railing to the frame structure by:

firstly, providing tubular spacer members and posts having base plates with apertures to receive fasteners;

secondly, cutting slots in one of the polymer plastic boards of a sufficient width to accommodate the spacer members and of a sufficient length to accommodate anticipated thermal expansion and contraction of the polymer plastic board;

thirdly, positioning the slotted polymer plastic board on the frame structure with the spacer members extending through the slots; and fourthly, securing the posts to the frame structure by driving fasteners through the apertures in the base plate of the post and through the tubular spacer member into the frame structure, such that thermal expansion and contraction of the polymer plastic board is accommodated by movement of the slots relative to the fixed tubular spacer members.

7. The method as defined in claim 1, the clip having at least one hole in each of the wing portions to accommodate fasteners, the at least hole in each of the wing portions being staggered on opposed sides of a dividing axis.

8. The method as defined in claim 7, the clip having at least one hole in the central portion to accommodate fasteners, the at least one hole being out of alignment with the at least one hole in each of the wing portions.

9. The method as defined in claim 1, each of the polymer plastic boards having a bottom face, a slot being placed in the bottom face having an axial leg and a transverse leg.

10. A method of deck construction using polymer plastic lumber, comprising the steps of:

firstly, forming a frame structure;

secondly, providing a plurality of tongue and groove style polymer plastic boards, each of the polymer plastic boards having an axially extending groove along one side and a projecting tongue along an opposed side;

thirdly, coupling pairs of polymer plastic boards in end to end relation by means of an interlocking butt joint to form composite polymer plastic boards;

fourthly, securing each of the composite polymer plastic boards sequentially to the frame structure by means of clips, each clip having a projecting tab that fit into the axially extending groove of the composite polymer plastic board, thereby securely fastening the composite polymer plastic board to the frame structure while permitting the axially extending groove to slide relative to the fixed clips upon thermal expansion and contraction of the composite polymer plastic board, the axially extending groove also accommodating the tongue of an adjacent composite polymer plastic board;

fifthly, securing posts to support a railing to the frame structure by:

providing tubular spacer members with broad weight distributing bases and posts having base plates with apertures to receive fasteners;

cutting slots in one of the composite polymer plastic boards of a sufficient width to accommodate the spacer members and of a sufficient length to accommodate anticipated thermal expansion and contraction of the composite polymer plastic board;

positioning the slotted composite polymer plastic board on the frame structure with the spacer members extending through the slots; and securing the posts to the frame structure by driving fasteners through the apertures in the base plate of the post and through the tubular spacer member into the frame structure, such that thermal expansion and contraction of the composite polymer plastic board is accommodated by movement of the slots relative to the fixed tubular spacer members.

11. The method as defined in claim 10, the interlocking butt joint being a dovetail joint.

12. The method as defined in claim 10, the clip being a flat piece of metal which can be bent insitu as required, the clip having a central portion, two opposed wing portions and a tab portion extending from the central portion intermediate the two wing portions, the clip having a hole in each of the wing portions to accommodate fasteners, the holes in each of the wing portions being staggered on opposed sides of a dividing axis.

13. The method as defined in claim 12, the clip having two holes in the central portion to accommodate fasteners, the holes being out of alignment with the holes in each of the wing portions.

14. The method as defined in claim 10, each of the polymer plastic boards having a bottom face, a slot being placed in the bottom face having an axial leg and a transverse leg.

* * * * *